US008420165B2

(12) United States Patent
Sato et al.

(10) Patent No.: US 8,420,165 B2
(45) Date of Patent: Apr. 16, 2013

(54) METHOD FOR PRODUCTION OF SILVER FINE POWDER COVERED WITH ORGANIC SUBSTANCE, AND SILVER FINE POWDER

(75) Inventors: Kimitaka Sato, Okayama (JP); Balachandran Jeyadevan, Sendai (JP); Kazuyuki Tohji, Sendaishi (JP)

(73) Assignees: Dowa Electronics Materials Co., Ltd., Tokyo (JP); Tokohu University, Miyagi (JP)

( * ) Notice: Subject to any disclaimer, the term of this patent is extended or adjusted under 35 U.S.C. 154(b) by 498 days.

(21) Appl. No.: 12/601,977

(22) PCT Filed: May 28, 2008

(86) PCT No.: PCT/JP2008/060240

§ 371 (c)(1),
(2), (4) Date: Jun. 1, 2010

(87) PCT Pub. No.: WO2008/149870

PCT Pub. Date: Dec. 11, 2008

(65) Prior Publication Data

US 2010/0279006 A1 Nov. 4, 2010

(30) Foreign Application Priority Data

May 30, 2007 (JP) ..... 2007-143134

(51) Int. Cl.
*B05D 7/00* (2006.01)

(52) U.S. Cl.
USPC ..... 427/216; 427/220

(58) Field of Classification Search ..... 427/216, 427/220

See application file for complete search history.

(56) References Cited

U.S. PATENT DOCUMENTS 5,658,499 A * 8/1997 Steinberg et al. ..... 252/514

FOREIGN PATENT DOCUMENTS

| | | |
|---|---|---|
| JP | 2006-89786 | 4/2006 |
| JP | 2006-219693 | 8/2006 |
| JP | 2007-39718 | 2/2007 |
| JP | 2008-95194 | 4/2008 |
| WO | 2004/012884 | 2/2004 |

OTHER PUBLICATIONS

M. Nakamoto et al, "Application of Silver Nanoparticles to Electroconductive Paste", Chemical Engineering, Kagaku Kogyo-sha, Oct. 2005, pp. 749-754.

* cited by examiner

*Primary Examiner* — Paul Marcantoni
(74) *Attorney, Agent, or Firm* — Clark & Brody

(57) ABSTRACT

Provided is a method for producing a silver fine powder covered with an organic substance, which comprises a step of mixing (i) a dispersion of silver particles covered with a protective material $X_1$ that comprises an organic compound having an unsaturated bond and having a molecular weight of from 150 to 1000 in a liquid organic medium A, (ii) a protective material $X_2$ that comprises an organic compound of which the number of the carbon atoms constituting the carbon skeleton is smaller than that of the organic compound to constitute the protective material $X_1$, and (iii) a liquid organic medium B of which the ability to dissolve the protective material $X_1$ therein is higher than that of the liquid organic medium A, thereby promoting the dissolution of the protective material $X_1$ in the liquid organic medium B and the adhesion of the protective material $X_2$ to the surface of the silver particles. Accordingly, the invention provides an industrial, large-scale mass-production system for a silver fine powder covered with a protective material having a low molecular weight, of which the sintering temperature can be greatly lowered.

16 Claims, 7 Drawing Sheets

METHOD FOR PRODUCTION OF SILVER FINE POWDER COVERED WITH ORGANIC SUBSTANCE, AND SILVER FINE POWDER

TECHNICAL FIELD

The present invention relates to a silver fine powder comprising silver nanoparticles covered with an organic substance, which is a silver fine powder of good sinterability suitable for ink and paste for construction of microwiring substrates, and relates to a method for producing it. "Fine powder" as referred to in this description means that the constitutive metal particles have a mean particle size of at most 20 nm, unless otherwise specifically indicated.

PRIOR ART

Metal fine powder has high activity and can be well sintered even at low temperatures, and therefore has been specifically noted for a long time as a patterning material on a base material having low resistance to heat. In particular, with recent progress of nanotechnology, it has become relatively easy to produce single nano-class particles in a simplified manner.

Patent Reference 1 discloses a method for producing a large quantity of silver nanoparticles, starting from silver oxide and using an amine compound. Patent Reference 2 discloses a method for producing silver nanoparticles by mixing and fusing an amine and a starting silver compound. Non-Patent Reference 1 describes formation of paste with silver nanoparticles. On the other hand, Patent Reference 3 discloses a method that comprises adding a polar solvent where an organic protective material B having a functional group of good compatibility with metal particles, such as a mercapto group or the like, has been dissolved, to a non-polar solvent where metal nanoparticles protected with an organic protective material A exist, followed by stirring and mixing them to thereby convert the protective material of the metal nanoparticles, from A to B.

Patent Reference 1: JP-A 2006-219693

Patent Reference 2: WO04/012884

Patent Reference 3: JP-A 2006-89786

Non-Patent Reference: Masami Nakamoto, et al., "Application of Silver Nanoparticles to Electroconductive Paste", Chemical Engineering, Kagaku Kogyo-sha, October 2005, pp. 749-754

Problems that the Invention is to Solve

In general, the surface of metal fine powder is usually covered with an organic protective material. The protective material plays a role of separating particles from each other in reaction of producing silver particles. Accordingly, it is advantageous to select the material having a large molecular weight in some degree. When the molecular weight of the material is small, then the distance between the particles may be narrow, and the particles may be much sintered in wet reaction of producing them. If so, the particles may grow large and coarse and it may be difficult to produce fine powder of particles.

On the other hand, when a metal fine powder covered with an organic protective material is used in forming microwiring patterns on a substrate, the metal fine particles must be sintered together after the formation of microwiring patterns thereon. In sintering the particles, the organic protective material existing between them must be removed through vaporization or the like. Some carbon may remain in the sintered pattern (wiring); but as increasing electric resistance, carbon is desired to be completely removed.

However, an organic protective material having a large molecular weight is generally difficult to remove through vaporization under heat. Therefore, for example, a silver powder could hardly form a sintered pattern (wiring) of high electroconductivity if not exposed to high temperatures such as 250° C. or higher. Accordingly, the type of the applicable substrate is limited to only a part of material having a high heat-resistant temperature, such as polyimide, glass, aramide, etc. Recently, a silver fine powder capable of being sintered even at 180° C. or so has been developed; but the limitation to substrates with it is still severe.

If industrial-scale production of a metal fine powder having a low sintering temperature of from 100 to 180° C., preferably from 100 to 150° C. or so is enabled, then inevitably the applications thereof will greatly expand. For example, when a transparent polycarbonate is used as a substrate, then microwiring patterns may be directly formed on the surfaces of CD, DVD and the like media and lenses, whereby various functions may be given thereto. Inexpensive antennas having microwiring patterns formed on a PET (polyethylene terephthalate) substrate, as well as paper-based IC tags may be realized. Further, it may become possible to directly form metal wiring patterns on an electroconductive polymer, whereby the applications of various electrode materials and others are expected to be further broadened. When silver is used as a metal fine powder, then it may exhibit its microbicidal effect. In addition, other numerous applications may be taken into consideration.

Patent Reference 3 discloses a technique of changing the protective material to cover the surface of metal particles to a different protective material. However, according to this technique, employed is a method of dropwise adding a reducing agent to the solvent where a metal donor substance and a protective material have been dissolved in the step of producing metal nanoparticles, thereby giving metal particles covered with the protective material. In the reaction of dropwise adding a reducing agent to a solvent as in the method, the reducing agent itself is diluted with the solvent and therefore the reducing agent to be used must have a strong reducing ability. In addition, even though the liquid is stirred, it is still not easy to precipitate metal nanoparticles with a completely uniform reducing power. Further, the particles may be contaminated with the ingredient of the reducing agent. Accordingly, the quality control in the method is difficult, for unifying the particle size distribution and for reducing the impurities in the metal particles. In addition, regarding the invention of Patent Reference No. 3, shown are examples of using an organic material having a small molecular weight of around 100, for example, naphthenic acid, octylamine or the like, as the protective material to be formed in the step of producing the particles; however, there is shown no concrete method of producing metal nanoparticles protected with an organic compound larger than that small compound. The metal nanoparticles covered with the protective material having such a small molecular weight may readily aggregate and precipitate in a liquid medium. In fact, the invention of Patent Reference 3 indispensably requires the step of settling and collecting the metal nanoparticle aggregates in the production step. Such particles that readily aggregate and settle could hardly keep their dispersion state in a liquid medium, and therefore take a lot of time and trouble in the intermediate step including washing; and in addition, it may be considered that the step of changing the protective material may indispensably require strong stirring and mixing operation for maintaining a uniform quality of the particles. To that effect, the technique of Patent Reference 3 needs further improvements for application to industrial mass-production, in point of the difficulty in uniform reduction control, and of the ready aggregation and sedimentation of particles (because of poor dispersibility thereof).

The present invention is to provide a silver fine powder covered with a protective material having a low molecular weight, of which the sintering temperature can be therefore much more lowered than before, according to a method applicable to industrial-scale mass-production.

Means for Solving the Problems

For attaining the above-mentioned object, the invention provides a method for producing a silver fine powder covered with an organic substance, which comprises a step of mixing (i) a dispersion of silver particles covered with a protective material $X_1$ that comprises an organic compound having an unsaturated bond and having a molecular weight of from 150 to 1000, preferably silver particles in which the existing ratio of the protective material $X_1$ to the total of the silver particles and the protective material $X_1$ is from 0.05 to 25% by mass, in a liquid organic medium A, (ii) a protective material $X_2$ that comprises an organic compound of which the number of the carbon atoms constituting the carbon skeleton is smaller than that of the organic compound to constitute the protective material $X_1$, preferably a protective material $X_2$ that comprises an organic compound of which the compatibility with the surface of the silver particles is larger than that of the organic compound to constitute the protective material $X_1$, and (iii) a liquid organic medium B of which the ability to dissolve the protective material $X_1$ is higher than that of the liquid organic medium A, thereby promoting the dissolution of the protective material $X_1$ in the liquid organic medium B and the adhesion of the protective material $X_2$ to the surface of the silver particles.

In the above, as the method of producing the silver particles covered with the protective material $X_1$, employed is a step of reducing a silver compound in an alcohol or a polyol and by the use of the alcohol or the polyol serving as a reducing agent, in the presence of an organic compound having an unsaturated bond and having a molecular weight of from 150 to 1000, thereby precipitating silver particles to produce a silver fine powder of the silver particles covered with the protective material $X_1$ comprising the organic compound; and thereafter employed is a step of producing a dispersion of the silver fine powder dispersed in the liquid organic medium A.

Preferred examples of the protective material $X_1$ include those comprising at least one of oleylamine and oleylamine derivatives.

The protective material $X_2$ includes at least one selected from organic carboxylic acids and organic carboxylic acid derivatives.

According to the invention, there is provided a technique of stably producing a silver fine powder protected with an organic protective material having a relatively small molecular weight. The method of the invention is especially effective, when applied to a method for producing silver particles disclosed by the present applicant in Japanese Patent Application No. 2005-222855, or that is, a production method where a silver salt is reduced in an alcohol or a polyol serving both as a solvent and a reducing agent and simultaneously the resulting particles are protected with an organic protective material having a relatively large molecular weight; and the method of the present invention is suitable for industrial-scale mass-production of a silver fine powder of which the sintering temperature is lowered more than before.

PREFERRED EMBODIMENTS

[Production of Silver Particles]

Figure 1:
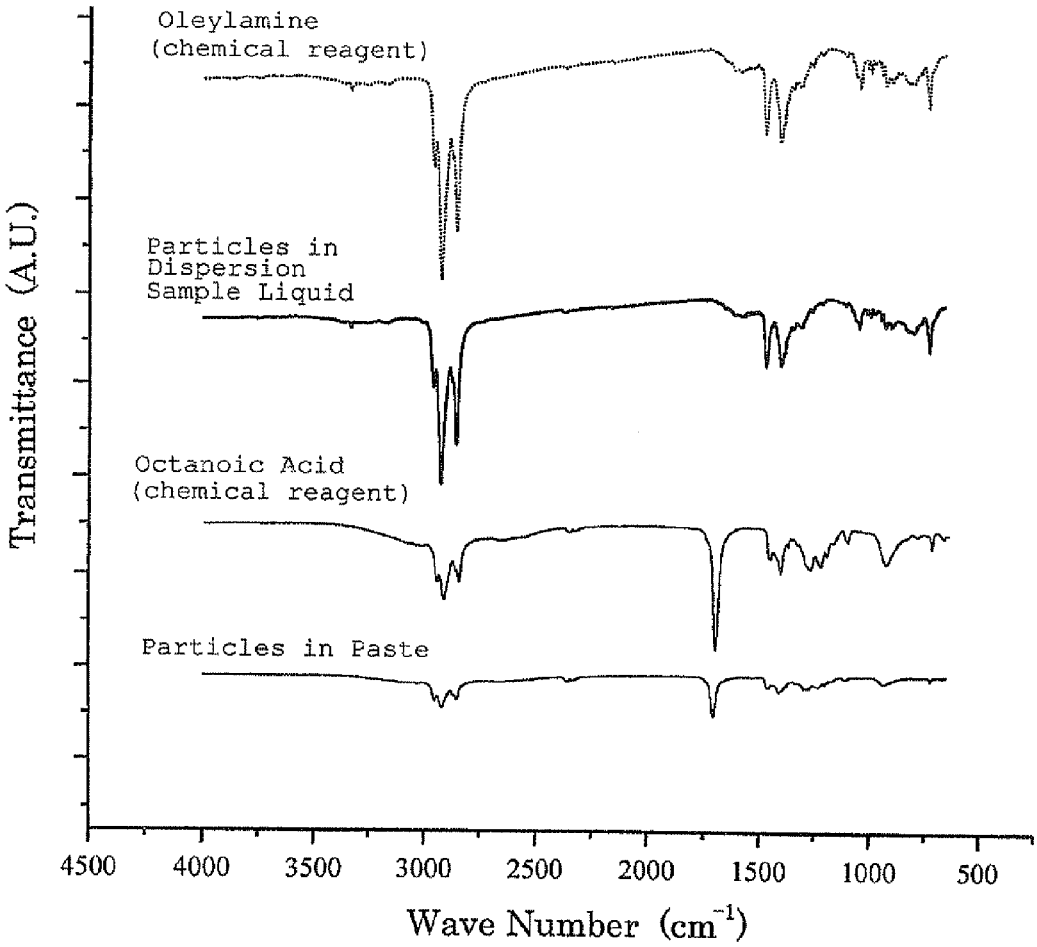
FIG. 1 shows FT-IR spectra in Example 1.

It is important that the starting material of silver fine powder for use in the invention has a stable particle morphology such as particle size distribution, and has a property of hardly aggregating and settling in a liquid medium. The silver fine powder of the type can be obtained, for example, according to the production method disclosed in Japanese Patent Application No. 2005-222855. Specifically, the production method is for reducing a silver compound in an alcohol or a polyol and by the use of the alcohol or the polyol serving as a reducing agent, thereby precipitating silver particles. In this case, the alcohol or the polyol is a solvent and is also a reducing agent. The reduction may be attained by heating the solvent liquid to be preferably in a reflux state. According to the method, the silver particles are prevented from being contaminated with impurities, and for example, when they are used as a wiring material (in other words, as an interconnecting material), the resistance of the formed wiring pattern may be reduced.

However, for promoting the reduction, it is important that an organic compound capable of functioning as a protective material is made to exist in the solvent. The organic compound is to constitute the protective material $X_1$ of the silver fine particles in the later step. The organic compound includes those shown in Japanese Patent Application No. 2005-222855, such as amines, fatty acids, etc. In particular, preferred are amines, especially those having an unsaturated bond. According to the present inventors' investigations, no one has succeeded in producing a silver fine powder at present, when an organic compound not having an unsaturated bond is used in a method of directly precipitating silver from a high-uniformity solvent in which a silver compound has been dissolved, like in the reduction step. Contrary to this, the inventors have found that, when an organic compound having an unsaturated bond is used, then a silver fine powder of which the surface is protected with the organic compound can be produced. The reasons are unclear in many points; at present, however, it may be presumed that, owing to the influence of the unsaturated bond that the organic compound has, the molecules of the organic compound may surround the surface of the precipitated silver and the organic compound may exhibit the function as a barrier so as to suppress the reduction into silver not to be over a predetermined level, and as a result, the growth of the silver particles may be controlled thereby giving silver nanoparticles having a relatively uniform particle size.

The inventors have known that, regarding the number of the unsaturated bond that the organic compound has, at least one unsaturated bond in one molecule of the compound may be enough. Two or more different types of such organic compounds may be used herein. Increasing the number of the unsaturated bond may control the number of the carbon atoms in the protective material $X_1$ existing on the surface of the silver particles, and therefore, an organic compound having a different number of unsaturated bond may be added in accordance with the necessity thereof.

In the invention, however, as the organic compound to constitute the protective material $X_1$, one capable of dissolving in the liquid organic solvent B that is to be mixed in the later step, must be used. Preferably, the organic compound to be used has a molecular weight of from 150 to 1000, more preferably from 200 to 400. When the organic compound having a too small molecular weight is used, then aggregation and sedimentation may occur in the liquid medium, thereby often detracting from uniform reduction. If so, quality control of the particles for unifying the particle size distribution thereof may be difficult. Still another disadvantage for industrial-scale mass-production is that the system requires strong stirring for dispersing the particles in the medium in the later step. On the contrary, when the organic compound to be used has a too large molecular weight, then the effect of inhibiting aggregation may be enhanced, but, on the other hand, the system requires a large amount of the liquid organic medium B in the later step of removing the protective material $X_1$ comprising the organic compound from the surface of the particles, and this is uneconomical. Further, the solubility of the compound in the liquid organic medium B may tend to lower.

Preferably, the organic compound to constitute the protective material $X_1$ is desired not to have a large adhesion force to the surface of the silver particles over the necessary level thereof. Specifically, in the invention, it is extremely effective to employ the protective material $X_1$ that has the property of being readily releasable from the silver particles in the later step.

As in the above, it is extremely effective that, as the organic compound to constitute the protective material $X_1$, those satisfying the following three characteristics are employed: [1] The molecular weight thereof is at least 150, and at the reduction temperature from 100 to 150° C. or so in the production, the compound is able to prevent the silver particles to be sintered; [2] the compound is soluble in the liquid organic medium B to be mentioned below; [3] the adhesion force thereof to the surface of the silver particles is not too high over the necessary level thereof. In addition, another important factor is that [4] in consideration of industrial-scale applicability of the invention, the compound is relatively easily available. The present inventors' detailed investigations have revealed that, as the organic compound to constitute the protective material $X_1$, for example, preferred is use of at least one of oleic acid, oleic acid derivatives, oleylamine and oleylamine derivatives. In particular, oleylamine satisfies the above-mentioned requirements [1] to [4] as well balanced.

The amount of the organic compound (to constitute the protective material $X_1$) that is to exist in the solvent during reduction may be from 0.1 to 20 equivalents relative to silver, more preferably from 1.0 to 15, even more preferably from 2.0 to 10 equivalents relative to silver. When the amount of the organic compound to be used is too small, then the amount of the protective material $X_1$ on the surface of the silver particles may be insufficient, and the particles could not be sufficiently dispersed in the liquid. When too large, the protective material $X_1$ may be difficult to sufficiently remove from the surface of the silver particles in the later step, and, in addition, the cost of the organic compound may increase, and therefore, this is unfavorable from the industrial viewpoint.

As the reducing agent, used is an alcohol or a polyol that acts as the solvent. Accordingly, silver nanoparticles contaminated with few impurities can be obtained. Refluxing is favorable for attaining efficient reaction. Accordingly, the boiling point of the alcohol or the polyol is preferably lower; and concretely, it may be from 80° C. to 300° C., preferably from 80° C. to 200° C., more preferably from 80° C. to 150° C. Also preferably, the alcohol has a longer carbon chain from the viewpoint of the reducing power thereof.

The alcohol includes propyl alcohol, n-butanol, isobutanol, sec-butyl alcohol, hexyl alcohol, heptyl alcohol, octyl alcohol, allyl alcohol, crotyl alcohol, cyclopentanol, etc. The polyol includes ethylene glycol, diethylene glycol, triethylene glycol, tetraethylene glycol, etc. Above all, preferred are isobutanol and n-butanol.

A reduction promoter may be added for the purpose of further promoting the reduction. Specific examples of the reduction promoter are disclosed in Japanese Patent Application No. 2005-222855; and at least one may be selected from them. Of those, especially preferred are diethanolamine and triethanolamine.

A silver compound to be the silver source may be any one capable of dissolving in the above-mentioned solvent, including, for example, silver chloride, silver nitrate, silver oxide, silver carbonate, etc. From the industrial viewpoint, silver nitrate is preferred. In the method of the invention, the Ag ion concentration in the liquid during the reaction may be at least 50 mmol/L, preferably from 0.05 to 5.0 mol/L. The molar ratio of organic compound/Ag may fall within a range of from 0.05 to 5.0. The molar ratio of reduction promoter/Ag may fall within a range of from 0.1 to 20.

In the silver particles covered with the protective material $X_1$ (produced through the above-mentioned reduction), the existing ratio of the protective material $X_1$ to the total of the silver particles and the protective material $X_1$ (hereinafter this may be simply referred to as "proportion of protective material $X_1$") is preferably so controlled as to fall from 0.05 to 25% by mass. When the proportion of the protective material $X_1$ is too small, then the particles may readily aggregate. On the contrary, when the proportion of the protective material $X_1$ becomes high, then the protective material $X_1$ may be difficult to sufficiently remove from the surface of the silver particles in the later step. In addition, when the proportion of the protective material $X_1$ is too high, this is problematic in that an ink having a high silver concentration could not be produced. In case where a silver fine powder-containing ink is applied onto a substrate, then dried and fired thereon to form an electroconductive material, the ink having a higher silver concentration enables to form a pattern of higher quality with little shrinkage. The proportion of the protective material $X_1$ may be controlled essentially by controlling the amount of the organic compound (mentioned above) that is to exist in the liquid during reduction.

The temperature in reduction is preferably within a range of from 50 to 200° C. When the reduction temperature is too low, then the alcohol and the like could hardly exhibit the reducing action thereof and the reaction could hardly go on and, in addition, reduction failure may occur. When the reduction temperature is too high, then the reduction may go on too rapidly, and the particles may be sintered in the liquid whereby the particles may grow largely and coarsely and the particle size may greatly fluctuate. In use as ink or paste for forming microwiring patterns, preferred are silver fine particles having a mean particle diameter $D_{TEM}$ (to be mentioned below) of at most 20 nm. More preferably, the reaction temperature is from 50 to 150° C., even more preferably from 60 to 140° C. Concretely, for example, the temperature is controlled to fall within a range of from 80 to 130° C. to attain better results.

As the case may be, the reduction may be attained in multi-stage reaction. Specifically, if the reduction occurs too rapidly, then the formed particles may grow too much. For effectively controlling the particle size, it is desirable that the reduction is first attained at a low temperature and then the reduction is further attained after the temperature is changed to a high temperature or while the temperature is gradually elevated. In this process, when the temperature difference is too large, then the particle size distribution may greatly change; and preferably, therefore, the difference between the lowest temperature and the highest temperature is within 20° C. More preferably, the temperature is severely so controlled that the difference is within 15° C., even more preferably within 10° C.

[Formation of Silver Particle Dispersion]

The silver fine powder covered with the protective material $X_1$ is, after produced through reduction, for example, in the above-mentioned wet process, subjected to solid-liquid separation and washing. Next, the obtained "silver particles/protective material $X_1$ composite" is mixed with a liquid organic medium A to produce a dispersion. The liquid organic medium A preferably comprises an organic substance in which the protective material $X_1$ is hardly soluble. When the protective material $X_1$ is readily soluble in the liquid organic medium A, then there may occur a phenomenon that the protective material $X_1$ removes from the surface of the silver particles in that stage, and during transportation or during handling the dispersion, the silver particles may be carelessly sintered together or may aggregate or settle down.

As the liquid organic medium A, preferred is a substance in which the silver fine powder covered with the protective material $X_1$ is well dispersible; and for example, preferred is use of hydrocarbons. In particular, usable are aliphatic hydrocarbons such as isooctane, n-decane, isododecane, isohexane, n-undecane, n-tetradecane, n-dodecane, tridecane, hexane, heptane, etc.; and aromatic hydrocarbons such as benzene, toluene, xylene, ethylbenzene, decalin, tetralin, etc. One or more of these substances may be used to be the liquid organic medium A.

[Covering with Protective Material $X_2$]

For covering the surface of the silver particles with the intended protective material $X_2$, in the invention, the dispersion of "silver particles/protective material $X_1$ composite" (mentioned above), and a liquid organic medium B in which the organic compound to constitute the protective material $X_1$ easily dissolves are mixed, whereby the protective material $X_1$ is released from the surface of the silver particles. In this stage, it is important that the releasing of the protective material $X_1$ is attained in the condition where the organic compound to constitute the protective material $X_2$ exists in the system. When the organic compound to constitute the protective material $X_2$ exists near the silver particles, then the surface of the silver particles may be rapidly covered with the protective material $X_2$ before the silver particles from which the protective material $X_1$ has been released aggregate together or are sintered. To that effect, it is desirable that the organic compound to constitute the protective material $X_2$ has a good affinity for the surface of the silver particles.

As the liquid organic medium B, used is a substance of which the ability to dissolve the organic compound of constituting the protective material $X_1$ is higher than that of the liquid organic medium A. As the substance of the type, used are alcohols as simple and economical. Many amine compounds such as typically oleylamine are, in general, hardly soluble in the above-mentioned liquid organic medium A but have a relatively good solubility in alcohols. The alcohols include relatively inexpensive and easily available methanol, ethanol, isopropanol, isobutanol, etc. Two or more different types of those substances may constitute the liquid organic medium B.

The protective material $X_2$ is preferably selected from substances having a relatively small molecular weight of, for example, at most 150, in order that the sintering temperature of the ink or paste comprising the silver fine powder could be low, for example, falling from 100 to 180° C., preferably from 100 to 150° C. Also preferred are those having a group that has a high affinity for the surface of the silver particles. However, in consideration of the use for forming silver interconnecting wire lines or electrodes through sintering, and from the viewpoint of attaining high electroconductivity, it is desirable that the protective material $X_2$ contains few impurity elements that may remain in the sintered silver body as solid solution or as fine inclusions therein after the protective material $X_2$ is removed away through vaporization. In particular, sulfur may form an insulating metal compound; and therefore, for use in the field of electronic parts, it is desirable that an organic compound having sulfur-containing functional group is not used.

Preferably, the organic compound to constitute the protective material $X_2$ is one capable of rapidly adhering to the surface of the silver particles from which the protective material $X_1$ has removed, or that is, the organic compound to constitute the protective material $X_2$ is preferably one having a higher affinity for the surface of the silver particles than the organic compound to constitute the protective material $X_1$. However, as so mentioned in the above, a surfactant (coupling agent) or the like that has the affinity for silver particles owing to its functional group containing sulfur or the like has a risk of detracting from the electroconductivity of the sintered body of silver; and therefore, it is desirable not to use it. The present inventors' detailed investigations have revealed that, when an amine compound having a molecular weight of at least 150, preferably at least 200 such as oleylamine ($C_9H_{18}{=}C_9H_{17}{-}NH_2$) or the like is used as the protective material $X_1$, especially when a monomer having a linear carbon skeleton is used, then it is readily released from the surface of silver particles (probably, the substance may not be adsorbed firmly). When the protective material $X_1$ of the type is used, then the surface of the silver particles may well be covered with the protective material $X_2$ even though a compound having a functional group of which the affinity (absorbability) for the metal surface has been specifically increased is not used as the organic compound to constitute the protective material $X_2$. For example, as the organic compound to constitute the protective material $X_2$, an ordinary organic carboxylic acid may be used, with which the surface of the silver particles may be sufficiently covered.

To that effect, it is unnecessary to select, as the organic compound to constitute the protective material $X_2$, a substance of which the adsorbability by the surface of silver particles is specifically increased owing to having a special functional group such as a sulfur-containing group. This feature is advantageous in point of ensuring the electroconductivity of the sintered body of silver. In the invention, the protective material $X_2$ may be formed of at least one organic compound selected from organic carboxylic acids and organic carboxylic acid derivatives. For example, there may be mentioned at least one organic compound selected from organic carboxylic acids and organic carboxylic acid derivatives in which the carbon skeleton has from 4 to 14 carbon atoms. Depending on use, a suitable organic compound may be selected, which is well dispersible in the medium for it. For lowering the sintering temperature of ink or paste, a silver dispersion of the silver fine powder covered with the protective material $X_2$ may be produced, in which the silver concentration is at least 60% by mass. Also preferably, the organic compound is so selected that, when the silver dispersion is applied onto a glass substrate according to a spin-coating method and thereafter the thus-formed coating film having a thickness of at most 1000 nm is baked in air, then the silver particles may be sintered at a temperature falling between 100 and 150° C. The fact as to whether or not the intended sintering has finished may be known by measuring the electric resistance of the baked body. Specifically, the electric resistance of the body that has been baked and sintered is significantly lower than that of the body that has been baked but has not been completely sintered as yet. The baked body which has been only partially sintered and of which the electric resistance is not as yet sufficiently lowered is not considered as "the sintered body" in this description.

For obtaining the silver fine powder covered with the protective material $X_2$, the following (i) to (iii) are mixed.

(i) Dispersion of "silver particles/protective material $X_1$ composite" dispersed in a liquid organic medium A, (ii) Organic compound to cover the silver particles as a protective material $X_2$, (iii) Liquid organic medium B in which the solubility of the protective material $X_1$ is higher than in the liquid organic medium A.

In this stage, it is important that the liquids (i) and (iii) are mixed in the presence of the organic compound of (ii). In other words, even though the organic compound (ii) is added after mixing the liquids (i) and (iii) to promote the release of the protective material $X_1$ from the silver particles, it is difficult to cover the individual silver particles with the protective material $X_2$. Specifically, it is important that, when the protective material $X_1$ is released from the silver particles, the organic compound to constitute the protective material $X_2$ exists around the particles.

For mixing the above (i) to (iii), for example, employable are the following mixing methods 1 to 3.

[Mixing Method 1]

A method of adding both the organic compound of (ii) and the liquid organic medium B of (iii) at the same time to the dispersion of (i).

[Mixing Method 2]

A method of previously mixing the dispersion of (i) and the organic compound of (ii), and thereafter mixing the resulting mixture with the liquid organic medium B of (iii).

[Mixing Method 3]

A method of previously mixing the liquid organic medium B of (iii) and the organic compound of (ii), and thereafter mixing the resulting mixture with the liquid of (i).

All these mixing methods may be attained at room temperature. Stirring the liquid does not require any specific forced stirring. Preferably, the amount of the liquid organic medium B to be used is one enough to dissolve the entire amount of the protective material $X_1$ of the "silver particles/protective material $X_1$ composite" therein. The amount to be used of the organic compound to constitute the protective material $X_2$ is to be such that the silver particles are completely covered with it, or that is, the silver particles thus covered with the protective materials $X_2$ are not sintered together on their metal surfaces in their mixing at room temperature.

Mixing the above (i) to (iii) gives a silver fine powder covered with the protective material $X_2$, and in general, this precipitates in the liquid. The liquid is processed for solid-liquid separation to thereby extract the silver fine powder covered with the protective material $X_2$, and thereafter the powder is stored in a liquid medium for storage/transportation, or is dispersed in a liquid medium for use for ink or paste. In that manner, the powder may be put into use.

EXAMPLES

[Production of Silver Particles]

200 mL of isobutanol (special grade chemical, by Wako Pure Chemical Industries) serving as a reaction medium and also as a reducing agent, 27 mL of oleylamine (by Wako Pure Chemical Industries, having a molecular weight of 267) as an organic compound (compound to constitute the protective material $X_1$), and 13.7 g of silver nitrate crystal (by Kanto Chemical) as a silver compound were prepared, and these were mixed and stirred with a magnetic stirrer to dissolve the silver nitrate. The resulting solution was transferred into a container equipped with a reflux condenser, put on an oil bath, and while nitrogen gas as an inert gas was jetted into the container at a flow rate of 400 mL/min, the solution was heated with stirring with the magnet stirrer at a revolution speed of 100 rpm. The heating speed up to 100° C. was 2° C./min. At the temperature of 100° C., this was kept refluxed for 3 hours, and then 8.5 g of a secondary amine, diethanolamine (by Wako Pure Chemical Industries, having a molecular weight of 106) as a reduction promoter was added thereto in a molar ratio to Ag of 1.0. Next, this was kept as such for 1 hour, and the reaction was thus finished. After the reaction, the slurry was processed for solid-liquid separation with a centrifuge, and the separated liquid was discarded and the solid matter was collected. Next, the washing operation of "mixing the solid matter with methanol, then processing it for solid-liquid separation with a centrifuge, discarding the separated liquid and collecting the solid matter" was repeated twice.

Formation of Silver Particle Dispersion

Tetradecane was prepared as a liquid organic medium A. The above-mentioned, washed solid matter was mixed and dispersed in this, then processed for solid-liquid separation with a centrifuge for 30 minutes, and the separated liquid was collected. In this liquid, the silver particles covered with the protective material $X_1$ is dispersed.

The silver particle dispersion was analyzed through a transmission electronic microscope (TEM) to determine the mean particle size $D_{TEM}$ thereof. Briefly, of the particles observed with TEM (JEOL's JEM-2010) at a magnification power of 600,000, 300 independent particles not overlapping with each other were analyzed to determine their diameter, and the data are averaged to give the mean particle size of the particles. As a result, $D_{TEM}$ was about 9.2 nm. The liquid was analyzed with a rotary viscometer (Toki Sangyo's RE550L). As a result, the silver particle dispersion had the following characteristics:

Silver concentration: 60.5% by mass,

Viscosity: 5.7 mPa·s.

Figure 7:
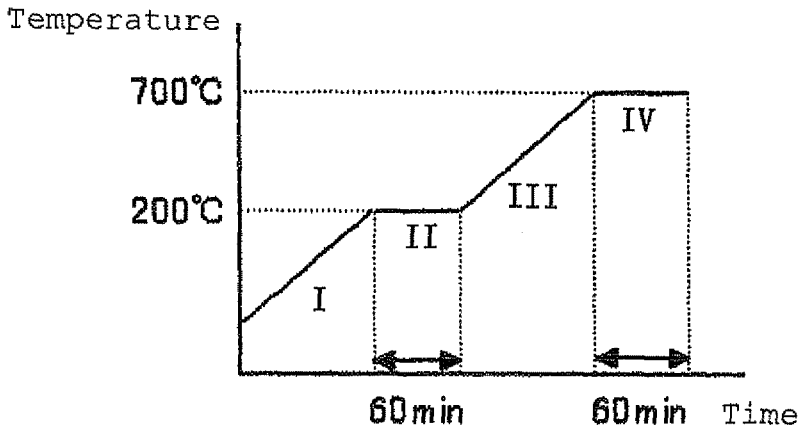
FIG. 7 is a view graphically showing the heat pattern given by a TG-DTA apparatus employed for measuring the proportion of the protective material $X_1$.

Using a TG-DTA apparatus, the existing ratio of the protective material $X_1$ to the total of the silver particles and the protective material $X_1$ (the proportion of the protective material $X_1$) was determined. For computing the proportion of the protective material $X_1$, employed is the heat pattern shown in FIG. 7. Concretely, first, the system is heated from room temperature up to 200° C. at a heating rate of 10° C./min (stage I), then kept at 200° C. for 60 minutes (stage II), and the organic medium in the dispersion (in this, tetradecane) is evaporated away. Next, the system is heated from 200° C. to 700° C. at a heating rate of 10° C./min (stage III), and again kept at 700° C. for 60 minutes (stage IV). It may be considered that, in the stages I and II, the organic medium may be completely evaporated away while the protective material $X_1$ remains; and in the stages III and IV, the protective material $X_1$ may be completely evaporated away. In the heat pattern of FIG. 7, the weight change is monitored with the TG-DTA apparatus; and at the end of the stage II, the weight change is nearly zero; and the weight loss $W_1$ up to this point corresponds to the weight of the organic medium (dispersion medium). After the start of the stage III, the weight begins to again decrease, and up to the end of the stage IV, the weight change becomes nearly zero. Accordingly, the new weight loss $W_2$ having occurred in the stages III and IV corresponds to the weight of the protective material $X_1$. The remaining weight $W_3$ corresponds to the net weight of silver. The proportion (%) of the protective material $X_1$ is computed as $W_2/(W_2+W_3)\times100$. As a result, the ratio of the protective material $X_1$ to "silver particles/protective material $X_1$ composite" in this dispersion was 6.7% by mass.

Example 1

50 mL of hexane was added to 100 μL of the above-mentioned silver particle dispersion to prepare a diluted dispersion. This liquid is a dispersion corresponding to the above-mentioned (i) where "silver particles/protective material $X_1$ composite" is dispersed in a liquid organic medium A; and this is hereinafter referred to as "silver dispersion sample liquid". In this silver dispersion sample liquid, the organic compound to constitute the protective material $X_1$ is oleylamine and the liquid organic medium A is hexane.

Octanoic acid was prepared as the organic compound to constitute a protective material $X_2$, and methanol was prepared as a liquid organic medium B. 5 mL of the above-mentioned silver dispersion sample liquid was taken; and at room temperature in air, 0.5 mL of octanoic acid ($CH_3(CH_2)_6COOH$)) and 10 mL of methanol were added to the liquid, then ultrasonically dispersed for 30 minutes, and thereafter centrifuged for 30 minutes to collect the solid matter (sedimentation). Octanoic acid and methanol, each in the same amount as above, were added to the solid matter, and then ultrasonically dispersed for 30 minutes, thereafter centrifuged for 30 minutes, and the solid matter was collected. The collected solid matter was washed with methanol to give a silver fine powder covered with octanoic acid (protective material $X_2$). A small amount of hexane was added to it, and processed with a kneading defoamer to give a paste.

Using FT-IR (Fourier transform infrared spectrometer), the chemical reagent oleylamine, the particles in the above-mentioned silver dispersion sample liquid, the chemical reagent octanoic acid, and the particles in the above-mentioned paste were analyzed for the spectrum of the organic compound therein. The results are shown in FIG. 1. As in FIG. 1, it is known that the silver particles in the silver particle dispersion are covered with oleylamine. Regarding the silver particles in the obtained paste, it is known that the oleylamine (protective material $X_1$) was removed, and in place of it, octanoic acid (protective material $X_2$) adhered to them. The pattern of the chemical reagent octanoic acid and that of the particles in the paste are analyzed well for the peak positions therein, and it is known that the peak positions in the latter are somewhat shifted as compared with those in the former. From this, it is presumed that the molecules of octanoic acid would form some chemical bond to the outermost surface of the silver particles. On the other hand, there is found little difference between the peak positions of the chemical reagent oleylamine and those of the particles in the silver dispersion sample liquid. From this, it is presumed that the chemical bonding of oleylamine to the surface of the silver particles may be weak and therefore this may be a factor of facilitating the release of the chemical reagent oleylamine from the surface of the silver particles.

Figure 4:
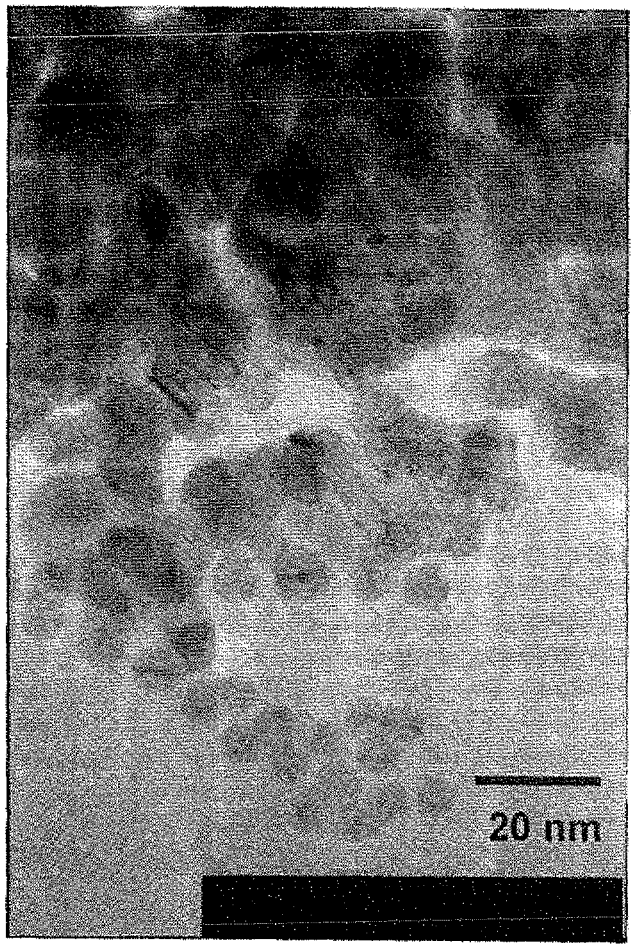
FIG. 4 is a TEM image of silver particles in the paste obtained in Example 1.

FIG. 4 shows a TEM image of the obtained paste. As in this, the silver particles are sintered together; and it may be considered as follows: Octanoic acid to constitute the protective material $X_2$ has a small molecular weight and is readily evaporated away, and therefore in high vacuum in TEM analysis, the sample was irradiated with electron beams to release octanoic acid, and the silver particles might be sintered.

Example 2

Figure 2:
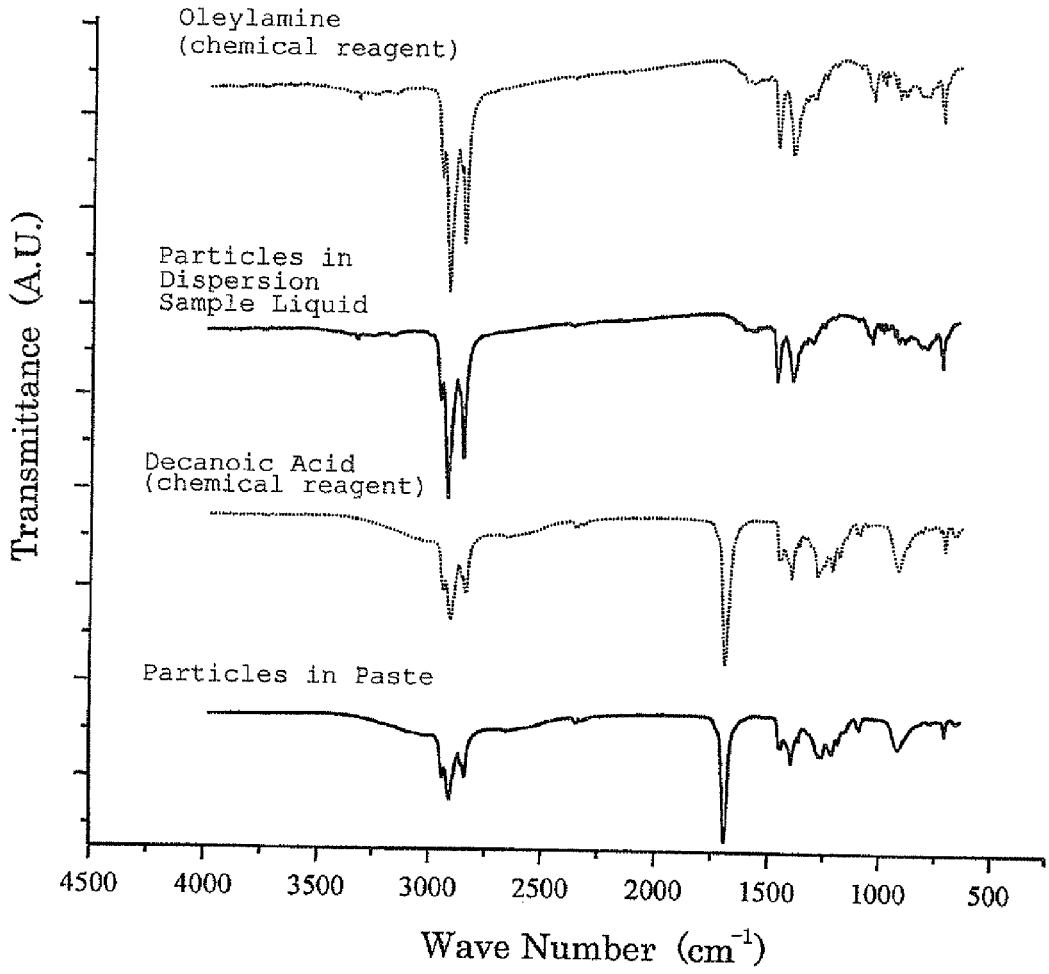
FIG. 2 shows FT-IR spectra in Example 2.

The same process as in Example 1 was carried out, in which, however, decanoic acid ($CH_3(CH_2)_8COOH$) was used in place of octanoic acid ($CH_3(CH_2)_6COOH$) as the organic compound to constitute the protective material $X_2$. The FT-IR spectra of the chemical reagent oleylamine, the particles in the silver dispersion sample liquid, the chemical reagent decanoic acid, and the particles in the paste are shown in FIG. 2. From FIG. 2, it is known that oleylamine (protective material $X_1$) was removed from the silver particles in the obtained paste, and in place of it, decanoic acid (protective material $X_2$) adhered to them.

Figure 5:
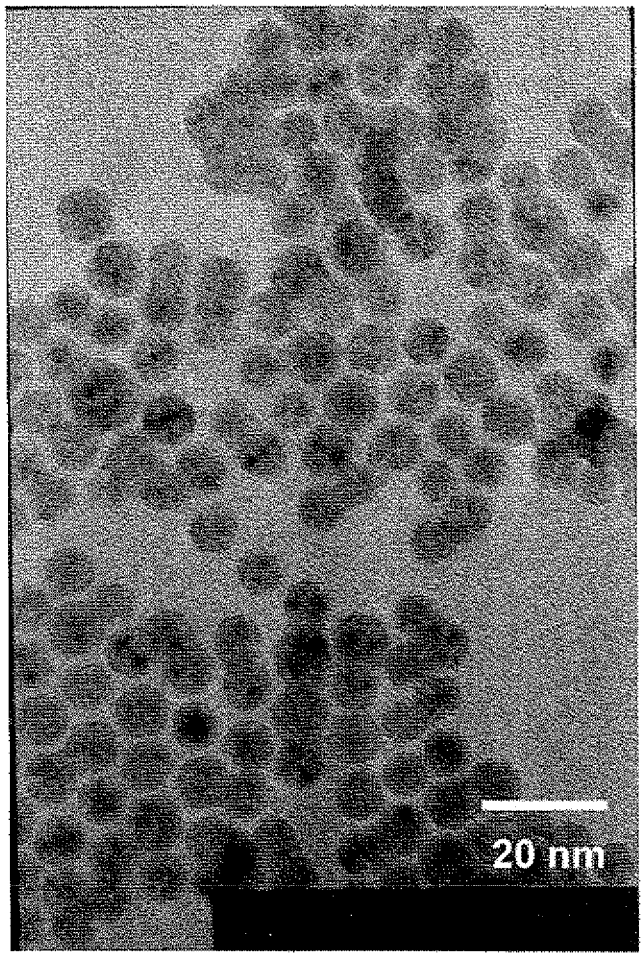
FIG. 5 is a TEM image of silver particles in the paste obtained in Example 2.

FIG. 5 shows a TEM image of the obtained paste. The condition for TEM analysis is the same as in Example 1 (FIG. 4). On the picture of FIG. 5, the sintering of the silver particles was reduced. This may be because decanoic acid to constitute the protective material $X_2$ has a larger molecular weight than octanoic acid in Example 1, and therefore its vaporization in TEM analysis might be small.

Example 3

Figure 3:
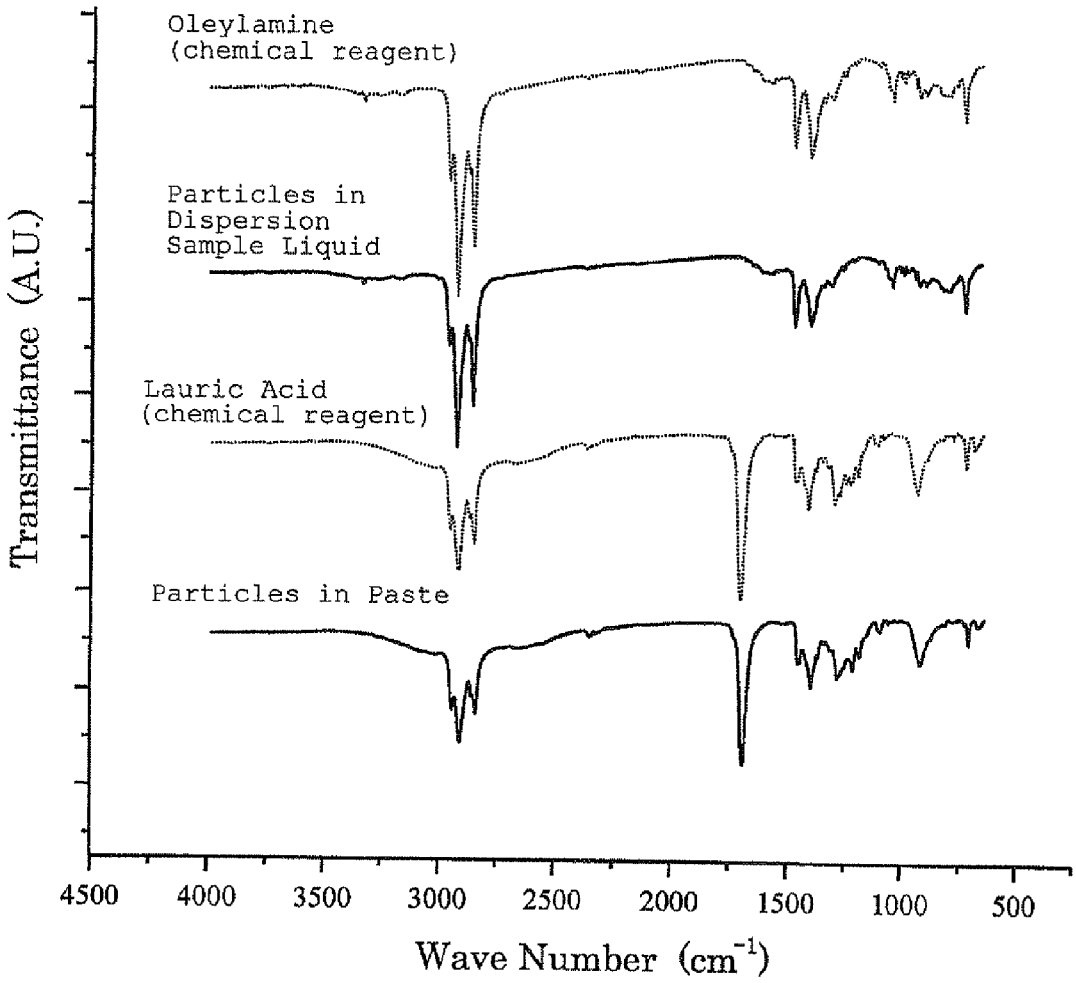
FIG. 3 shows FT-IR spectra in Example 3.

The same process as in Example 1 was carried out, in which, however, lauric acid ($CH_3(CH_2)_{10}COOH$) was used in place of octanoic acid ($CH_3(CH_2)_6COOH$) as the organic compound to constitute the protective material $X_2$. The FT-IR spectra of the chemical reagent oleylamine, the particles in the silver dispersion sample liquid, the chemical reagent lauric acid, and the particles in the paste are shown in FIG. 3. From FIG. 3, it is known that oleylamine (protective material $X_1$) was removed from the silver particles in the obtained paste, and in place of it, lauric acid (protective material $X_2$) adhered to them.

Figure 6:
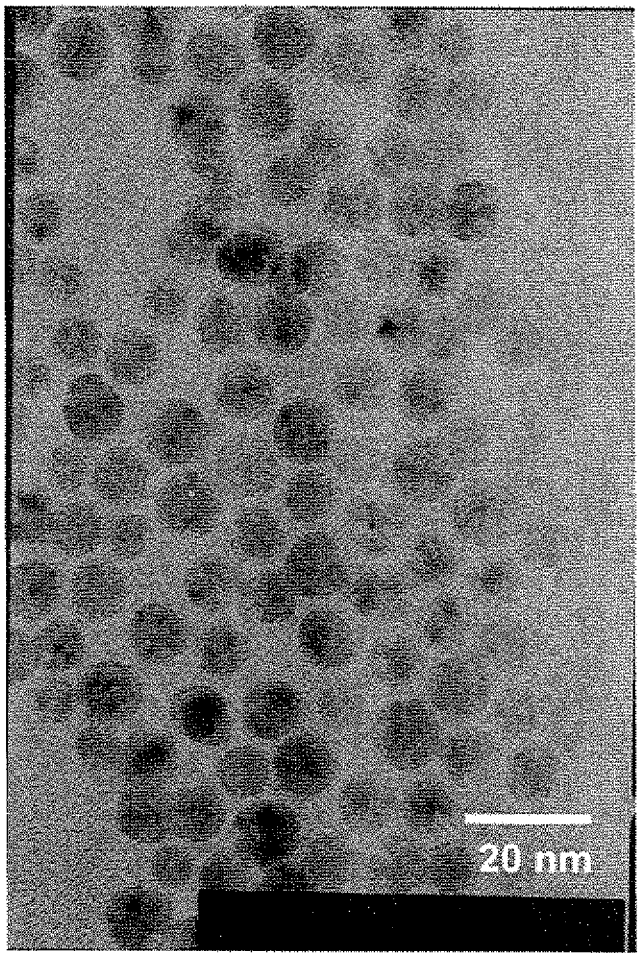
FIG. 6 is a TEM image of silver particles in the paste obtained in Example 3.

FIG. 6 shows a TEM image of the obtained paste. The condition for TEM analysis is the same as in Example 1 (FIG. 4) and Example 2 (FIG. 5). On the picture of FIG. 6, the sintering of the silver particles was more reduced than on FIG. 5. This may be because lauric acid to constitute the protective material $X_2$ has a larger molecular weight than decanoic acid in Example 2, and therefore its vaporization in TEM analysis might be further smaller. To that effect, from TEM analysis made under the same condition, it is presumed that, by covering silver particles with an organic compound having a smaller molecular weight as the protective material $X_2$, the sintering temperature of ink and paste comprising the particles may be lowered.

The invention claimed is:

1. A method for producing a silver fine powder covered with an organic substance, which comprises a step of mixing a dispersion of silver particles covered with a protective material $X_1$ that comprises an organic compound having an unsaturated bond and having a molecular weight of from 150 to 1000 in a liquid organic medium A, a protective material $X_2$ that comprises an organic compound of which the number of the carbon atoms constituting the carbon skeleton is smaller than that of the organic compound to constitute the protective material $X_1$, and a liquid organic medium B of which the ability to dissolve the protective material $X_1$ therein is higher than that of the liquid organic medium A, thereby promoting the dissolution of the protective material $X_1$ in the liquid organic medium B and the adhesion of the protective material $X_2$ to the surface of the silver particles.

2. A method for producing a silver fine powder covered with an organic substance, which comprises a step of reducing a silver compound in an alcohol or polyol and by the use of the alcohol or the polyol serving as a reducing agent, in the presence of an organic compound having an unsaturated bond and having a molecular weight of from 150 to 1000, thereby precipitating silver particles to produce a silver fine powder of the silver particles covered with a protective material $X_1$ comprising the organic compound, a step of preparing a dispersion of the silver fine powder dispersed in a liquid organic medium A, a step of mixing the dispersion, a protective material $X_2$ that comprises an organic compound of which the number of the carbon atoms constituting the carbon skeleton is smaller than that of the organic compound to constitute the protective material $X_1$, and a liquid organic medium B of which the ability to dissolve the protective material $X_1$ therein is higher than that of the liquid organic medium A, thereby promoting the dissolution of the protective material $X_1$ in the liquid organic medium B and the adhesion of the protective material $X_2$ to the surface of the silver particles.

3. The method for producing a silver fine powder as claimed in claim 1, wherein, the silver particles covered with the protective material $X_1$, the existing ratio of the protective material $X_1$ to the total of the silver particles and the protective material $X_1$ is from 0.05 to 25% by mass.

4. The method for producing a silver fine powder as claimed in claim 1, wherein the protective material $X_1$ comprises at least one of oleylamine and oleylamine derivatives.

5. The method for producing a silver fine powder as claimed in claim 1, wherein the protective material $X_2$ comprises a substance having a larger affinity for the surface of the silver particles than the substance to constitute the protective material $X_1$.

6. The method for producing a silver fine powder as claimed in claim 1, wherein the protective material $X_2$ comprises at least one selected from organic carboxylic acids and organic carboxylic acid derivatives.

7. The method for producing a silver fine powder as claimed in claim 2, wherein, the silver particles covered with the protective material $X_1$, the existing ratio of the protective material $X_1$ to the total of the silver particles and the protective material $X_1$ is from 0.05 to 25% by mass.

8. The method for producing a silver fine powder as claimed in claim 2, wherein the protective material $X_1$ comprises at least one of oleylamine and oleylamine derivatives.

9. The method for producing a silver fine powder as claimed in claim 3, wherein the protective material $X_1$ comprises at least one of oleylamine and oleylamine derivatives.

10. The method for producing a silver fine powder as claimed in claim 2, wherein the protective material $X_2$ comprises a substance having a larger affinity for the surface of the silver particles than the substance to constitute the protective material $X_1$.

11. The method for producing a silver fine powder as claimed in claim 3, wherein the protective material $X_2$ comprises a substance having a larger affinity for the surface of the silver particles than the substance to constitute the protective material $X_1$.

12. The method for producing a silver fine powder as claimed in claim 4, wherein the protective material $X_2$ comprises a substance having a larger affinity for the surface of the silver particles than the substance to constitute the protective material $X_1$.

13. The method for producing a silver fine powder as claimed in claim 2, wherein the protective material $X_2$ comprises at least one selected from the group consisting of organic carboxylic acids and organic carboxylic acid derivatives.

14. The method for producing a silver fine powder as claimed in claim 3, wherein the protective material $X_2$ comprises at least one selected from the group consisting of organic carboxylic acids and organic carboxylic acid derivatives.

15. The method for producing a silver fine powder as claimed in claim 4, wherein the protective material $X_2$ comprises at least one selected from the group consisting of organic carboxylic acids and organic carboxylic acid derivatives.

16. The method for producing a silver fine powder as claimed in claim 5, wherein the protective material $X_2$ comprises at least one selected from the group consisting of organic carboxylic acids and organic carboxylic acid derivatives.

* * * * *

UNITED STATES PATENT AND TRADEMARK OFFICE

CERTIFICATE OF CORRECTION

PATENT NO. : 8,420,165 B2
APPLICATION NO. : 12/601977
DATED : April 16, 2013
INVENTOR(S) : Kimitaka Sato et al.

It is certified that error appears in the above-identified patent and that said Letters Patent is hereby corrected as shown below:

On the Title Page, Item 73

Tokohu University should read:

Tohoku University

Signed and Sealed this
Twenty-ninth Day of October, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,420,165 B2
APPLICATION NO. : 12/601977
DATED : April 16, 2013
INVENTOR(S) : Sato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 681 days.

Signed and Sealed this
First Day of September, 2015

Michelle K. Lee

Michelle K. Lee
*Director of the United States Patent and Trademark Office*